US011619386B2

(12) United States Patent
Cowan

(10) Patent No.: US 11,619,386 B2
(45) Date of Patent: Apr. 4, 2023

(54) METHOD AND SYSTEM FOR AUTO-CALIBRATING AN IGNITION PROCESS OF A DIGITAL GAS COOKING APPLIANCE

(71) Applicant: Midea Group Co., Ltd., Foshan (CN)

(72) Inventor: Richard W. Cowan, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 56 days.

(21) Appl. No.: 17/174,584

(22) Filed: Feb. 12, 2021

(65) Prior Publication Data

US 2022/0260253 A1 Aug. 18, 2022

(51) Int. Cl.
*F23N 5/10* (2006.01)
*F23N 5/12* (2006.01)

(52) U.S. Cl.
CPC ..... *F23N 5/102* (2013.01); *F23N 5/105* (2013.01); *F23N 5/123* (2013.01); *F23N 5/126* (2013.01); *F23N 2225/16* (2020.01); *F23N 2227/02* (2020.01); *F23N 2227/20* (2020.01); *F23N 2229/20* (2020.01); *F23N 2241/08* (2020.01)

(58) Field of Classification Search
None
See application file for complete search history.

(56) References Cited

U.S. PATENT DOCUMENTS

| | | | |
|---|---|---|---|
| 4,645,450 | A | 2/1987 | West |
| 5,924,857 | A | 7/1999 | Frasnetti et al. |
| 6,619,613 | B1 | 9/2003 | Akamatsu et al. |
| 6,752,621 | B2 | 6/2004 | Rusche et al. |
| 7,241,135 | B2 | 7/2007 | Munsterhuis et al. |
| 8,066,508 | B2 | 11/2011 | Nordberg et al. |
| 2007/0243495 | A1 | 10/2007 | Crnkovich et al. |
| 2009/0241935 | A1 | 10/2009 | Jaaz et al. |

FOREIGN PATENT DOCUMENTS

| | | | |
|---|---|---|---|
| DE | 102015223681 | A1 | 6/2017 |
| DE | 102016106239 | A1 | 10/2017 |
| JP | H5010512 | A | 2/1975 |
| KR | 101407744 | B1 | 6/2014 |
| WO | WO2000063620 | A1 | 10/2000 |
| WO | WO2017005616 | | 1/2017 |
| WO | WO2020008088 | A2 | 1/2020 |

*Primary Examiner* — Jason Lau
(74) *Attorney, Agent, or Firm* — Gray Ice Higdon

(57) ABSTRACT

A digital gas cooking appliance is disclosed. The digital gas cooking appliance has the ability of self-initiating an automatic calibration process to determine an optimum valve position to be used for an electromechanical valve when igniting a gas cooking element by performing a plurality of ignition sequences for the gas cooking element at a plurality of respective valve positions of the electromechanical valve. During each of the plurality of ignition sequences, a respective ignition duration between a start of the respective ignition sequence when an igniter is active and the electromechanical valve is open, and a flame is detected by a flame detector, may be determined.

18 Claims, 6 Drawing Sheets

METHOD AND SYSTEM FOR AUTO-CALIBRATING AN IGNITION PROCESS OF A DIGITAL GAS COOKING APPLIANCE

BACKGROUND

Unlike an electrical cooking element, a gas cooking element generally requires an ignition process to be performed at the beginning of a cooking operation to lite the gas fuel supplied to the gas cooking element. Traditionally, ignition has been a mostly manual process, whereby a user is required to open a gas valve (e.g., by turning a rotary control knob) and ignite the gas cooking element once gas begins to flow from the gas cooking element (e.g., using a spark ignitor that is activated when the knob is turned to a specific position). More recently, digital gas cooking appliances have been developed, utilizing electronically-controllable gas valves and automatic ignition functionality. With such systems, an automatic ignition process may be initiated by a user by pressing an ignite button or otherwise signaling a desire to ignite a gas cooking element, and the ignition process is generally performed by controlling an electromechanical gas valve to initiate a flow of gas to a gas cooking element and then activating an electronically-controlled ignitor once that gas flow has been initiated. Once a flame has been established, the ignitor may be deactivated and the flame can then be adjusted by a user to a desired output level.

Determining the optimum gas flow for use in an automatic ignition process, however, is not particularly straightforward. Gas flow rates that are too high or too low can result in poor ignition characteristics, and may result in either a failure ignite, or at least an unduly long delay between when a user requests ignition of a gas cooking element and when the gas cooking element is lit and ready to use. The optimum gas flow rate may vary based upon a number of factors, e.g., the size or maximum output of the gas burner, the input gas pressure, the input gas type (e.g., natural gas, propane, etc.), etc. Furthermore, these factors may change over time, e.g., as a result of changes in gas pressure, a switchover to a different gas type, etc. Ignition failures and/or delays can at the least lead to user dissatisfaction and frustration.

A need therefore exists in the art for a manner of optimizing the ignition process of a digital gas cooking appliance.

SUMMARY

The herein-described embodiments address these and other problems associated with the art by providing in one aspect a digital gas cooking appliance that includes a gas cooking element including an igniter, an electromechanical valve coupled with the gas cooking element to regulate a gas flow rate thereto, a flame detector configured to detect a flame of the gas cooking element, a user control configured to control an output level of the gas cooking element through movement of the user control within a range of positions; and a controller coupled to the igniter, the electromechanical valve, the flame detector, and the user control to control the electromechanical valve to regulate the output level of the gas cooking element in response to user input received through the user control. The controller is configured to initiate a calibration process by performing a plurality of ignition sequences for the gas cooking element at a plurality of respective valve positions for the electromechanical valve. During each of the plurality of ignition sequences, the controller is configured to set the electromechanical valve to the respective valve position and determine a respective ignition duration between a start of the respective ignition sequence when the igniter is active and the electromechanical valve is open, and detection of the flame of the gas cooking element by the flame detector.

In some embodiments, the controller is further configured to determine an optimum valve position of the electromechanical valve for ignition of the gas cooking element from the determined respective ignition durations to minimize ignition duration to determine a minimum ignition duration. In such embodiments, the controller is further configured to use the determined optimum valve position to set the electromechanical valve during ignition in response to user input to ignite the gas cooking element.

In some embodiments, the controller is configured to perform the plurality of ignition sequences by determining a starting valve position corresponding to a starting ignition duration; initiating a first ignition sequence of the plurality of ignition sequences by moving the electromechanical valve from the starting valve position in a first valve moving direction to a first ignition sequence valve position and determining a first ignition sequence ignition duration corresponding to the first ignition sequence valve position; determining a desired valve moving direction of decreasing the ignition duration for use in at least one additional ignition sequence of the plurality of ignition sequences subsequent the first ignition sequence by comparing the first ignition sequence ignition duration with the starting ignition duration, wherein the desired valve moving direction is the first valve moving direction if the first ignition sequence ignition duration is shorter than the starting ignition duration or a second valve moving direction opposite from the first valve moving direction if the first ignition sequence ignition duration is longer than the starting ignition duration; and initiating the at least one additional ignition sequence of the plurality of ignition sequences, including, during each of the at least one additional ignition sequence of the plurality of ignition sequences, moving the electromechanical valve in the desired valve moving direction to the respective valve position and determining the respective ignition duration.

In some embodiments, the controller is configured to move the electromechanical valve in the desired valve moving direction with a fixed change amount of the gas flow rate to the respective valve position and determine the respective ignition duration. In some embodiments, the controller is configured to determine the starting valve position corresponding to the starting ignition duration based on a size of the gas cooking element, a type of the gas cooking element, a size of the electromechanical valve, a type of the electromechanical valve, and/or a type of gas being supplied to the gas cooking element. In some embodiments, the controller is further configured to delay between each of the plurality of ignition sequences to allow for cooling down of the gas cooking element. In some embodiments, the controller is further configured to override the determined optimum valve position of the electromechanical valve for ignition of the gas cooking element in response to user input.

In some embodiments, the controller is further configured to initiate the calibration process after conversion of the digital gas cooking appliance to use a different type of gas. In some embodiments, the controller is further configured to initiate the calibration process at an initial setup of the digital gas cooking appliance. In some embodiments, the controller is further configured to initiate the calibration process on demand in response to user input.

In some embodiments, the controller is further configured to generate an alert for a user in response to determining the calibrated ignition duration determined after the calibration process meets a predetermined ignition duration criterion. In such embodiments, the predetermined ignition duration criterion includes an optimum ignition duration based on empirical testing and set during manufacture. In some embodiments, the controller is further configured to initiate a diagnostic process by suggesting an ignition performance improving action to a user, and the ignition performance improving action includes an adjustment/cleaning of the gas cooking element and/or the igniter, or an inspection of the type/pressure of the gas supplied. In some embodiments, the alert for the user includes a sound alert, a visual alert, or a haptic alert. In some embodiments, the flame detector includes a thermocouple, a flame sense rod, or a vision system.

In some embodiments, a digital gas cooking appliance includes a gas cooking element including an igniter, an electromechanical valve coupled with the gas cooking element to regulate a gas flow rate thereto, a flame detector configured to detect a flame of the gas cooking element, a user control configured to control an output level of the gas cooking element through movement of the user control within a range of positions; and a controller coupled to the igniter, the electromechanical valve, the flame detector, and the user control to control the electromechanical valve to regulate the output level of the gas cooking element in response to user input received through the user control. The controller is configured to initiate a calibration process in response to determining a present ignition duration for the gas cooking element between a start of an ignition sequence when the igniter is active and the electromechanical valve is open, and detection of the flame of the gas cooking element by the flame detector, meets a predetermined ignition duration criterion. In such embodiments, the controller is further configured to initiate a calibration process by performing a plurality of ignition sequences for the gas cooking element at a plurality of respective valve positions for the electromechanical valve. During each of the plurality of ignition sequences, the controller is configured to set the electromechanical valve to the respective valve position and determine a respective ignition duration between a start of the respective ignition sequence when the igniter is active and the electromechanical valve is open, and detection of the flame of the gas cooking element by the flame detector. In some embodiments, the controller is further configured to initiate an alert in response to determining the present ignition duration for the gas cooking element meets the predetermined ignition duration criterion.

In some embodiments, a digital gas cooking appliance includes a gas cooking element including an igniter, an electromechanical valve coupled with the gas cooking element to regulate a gas flow rate thereto, a flame detector configured to detect a flame of the gas cooking element, a user control configured to control an output level of the gas cooking element through movement of the user control within a range of positions; and a controller coupled to the igniter, the electromechanical valve, the flame detector, and the user control to control the electromechanical valve to regulate the output level of the gas cooking element in response to user input received through the user control. In such embodiments, the controller is further configured to initiate a calibration process by performing a plurality of ignition sequences for the gas cooking element at a plurality of respective valve positions for the electromechanical valve. During each of the plurality of ignition sequences, the controller is configured to set the electromechanical valve to the respective valve position and determine a respective ignition duration between a start of the respective ignition sequence when the igniter is active and the electromechanical valve is open, and detection of the flame of the gas cooking element by the flame detector. In some embodiments, the controller is further configured to initiate an alert in response to determining the present ignition duration for the gas cooking element meets the predetermined ignition duration criterion.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. All of the above outlined features are to be understood as exemplary only and many more features and objectives of the various embodiments may be gleaned from the disclosure herein. Therefore, no limiting interpretation of this summary is to be understood without further reading of the entire specification, claims and drawings, included herewith. A more extensive presentation of features, details, utilities, and advantages of the present disclosure is provided in the following written description of various embodiments of the disclosure, illustrated in the accompanying drawings, and defined in the appended claims.

DETAILED DESCRIPTION

Figure 1:
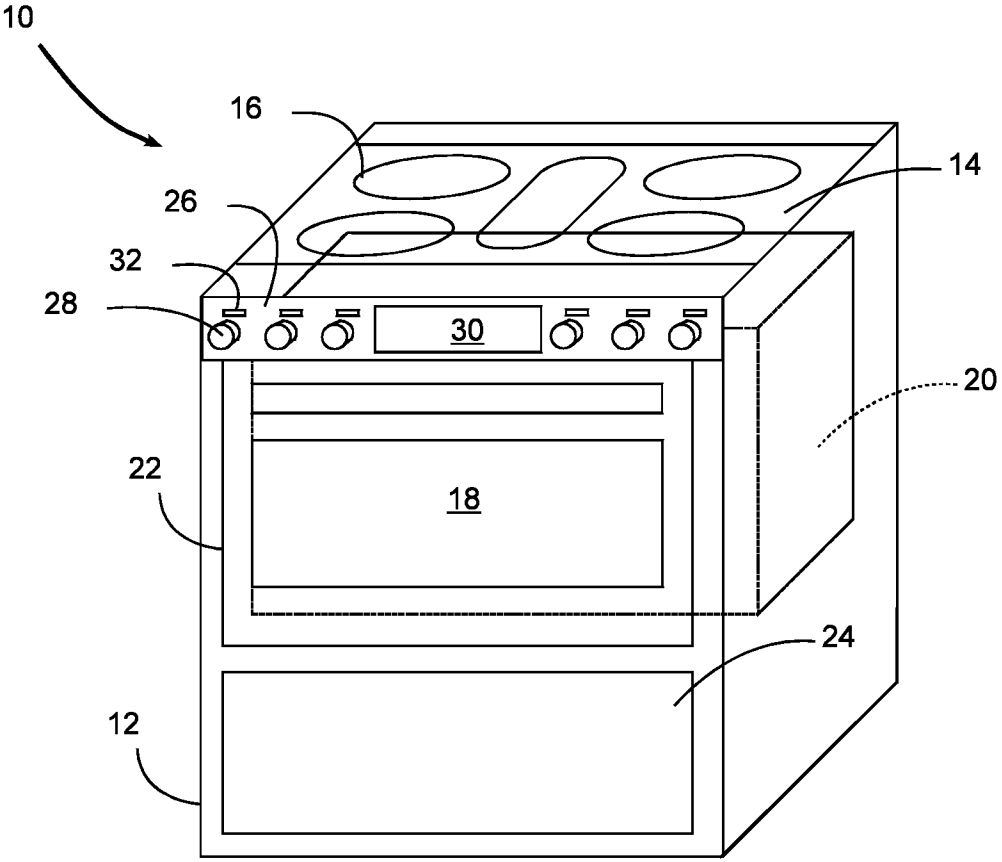
FIG. 1 is a perspective view of a digital gas cooking appliance, consistent with some embodiments of the disclosure.

It is to be understood that a digital gas cooking appliance with ignition calibrating ability is not limited in its application to the details of construction and the arrangement of components set forth in the following description or illustrated in the drawings. The described embodiments are capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to direct physical or mechanical connections or couplings. It should be noted that the calibrating mechanism could vary greatly and still accomplish the same intent.

The embodiments discussed hereinafter will, for convenience only, focus on the implementation of the hereinafter-described apparatus and techniques within a digital gas cooking appliance. As shown in the figures, the particular embodiment depicted shows a gas cooking appliance with a plurality of gas cooking elements, such as a plurality of cooktop burners and an oven. However, it will be appreciated that the apparatus and techniques may also be used in connection with other types of digital gas cooking appliances, and even with other types of gas equipment and/or systems. For example, the digital gas cooking appliance might have only one cooktop burner, might not include an oven, or might even be just an oven with no cooktop burners.

Turning now to the drawings, wherein like numbers denote like parts throughout the several views, FIG. 1 illustrates an example cooking appliance 10 in which the various technologies and techniques described herein may be implemented. The cooking appliance 10 is a residential-type range, and as such includes a housing 12, a stovetop or cooktop 14 including a plurality of burners 16, and an oven 18 defining an oven or cooking cavity 20 accessed via an oven door 22. The cooking appliance 10 may also include a storage drawer 24 in some embodiments, or in other embodiments, may include a second oven. Various cooking elements (not shown in FIG. 1) may also be incorporated into the cooking appliance 10 for cooking food in the oven 18, e.g., one or more electric or gas heating elements.

The cooking appliance 10 may also include various user interface devices, including, for example, a control panel 26 incorporating a plurality of rotary burner controls 28 and a user interface or display 30 for providing visual feedback as to the activation state of the cooking appliance. In some embodiments, each rotary burner control 28 may include an associated electronic burner control user interface or display 32 that is disposed on or adjacent to a knob or rotary control actuator of the rotary burner control 28, while in other embodiments, no control-specific displays may be used. It will be appreciated that the cooking appliance 10 may include various types of user controls in other embodiments, including various combinations of switches, buttons, knobs and/or sliders, typically disposed at the rear or front (or both) of the cooking appliance. Further, in some embodiments, one or more touch screens may be employed for interaction with a user. As such, in some embodiments, display 30 may be touch sensitive to receive user input in addition to displaying status information and/or otherwise interacting with a user. In still other embodiments, the cooking appliance 10 may be controllable remotely, e.g., via a smartphone, tablet, personal digital assistant or other networked computing device, e.g., using a web interface or a dedicated app. In some embodiments, both the cooktop burners and the oven may be controlled by the same electronic control system, while in other embodiments, different control systems may be used for separate control of each system.

Each of the user interfaces/displays 30, 32 may also vary in different embodiments, and may include individual indicators, segmented alphanumeric displays, and/or dot matrix displays, and may be based on various types of display technologies, including LEDs, vacuum fluorescent displays, incandescent lights, etc. Further, in some embodiments audio feedback may be provided to a user via one or more speakers, and in some embodiments, user input may be received via a spoken or gesture-based interface.

As noted above, the cooking appliance 10 of FIG. 1 may be a range, which combines a stovetop or cooktop with one or more ovens, and which in some embodiments may be a standalone or drop-in type of range. In other embodiments, however, the cooking appliance 10 may be another type of cooking appliance, e.g., a wall mount or freestanding oven, a drop-in stovetop or cooktop, etc. In general, a cooking appliance consistent with the disclosure may be considered to include any residential-type appliance including a housing and one or more gas cooking elements disposed thereon and/or therein and configured to generate energy for cooking food.

In turn, a cooking element may be considered to include practically any type of energy-producing element used in residential applications in connection with cooking food, e.g., employing various cooking technologies such as electric, gas, light, microwaves, induction, convection, radiation, etc. In the case of an oven, for example, one or more cooking elements therein may be gas, electric, light, or microwave heating elements in some embodiments, while in the case of a stovetop, one or more cooking elements therein may be gas, electric, or inductive heating elements in some embodiments. Further, it will be appreciated that any number of cooking elements may be provided in a cooking appliance, and that multiple types of cooking elements may be combined in some embodiments, e.g., combinations of microwave and light cooking elements in some oven embodiments.

Figure 2:
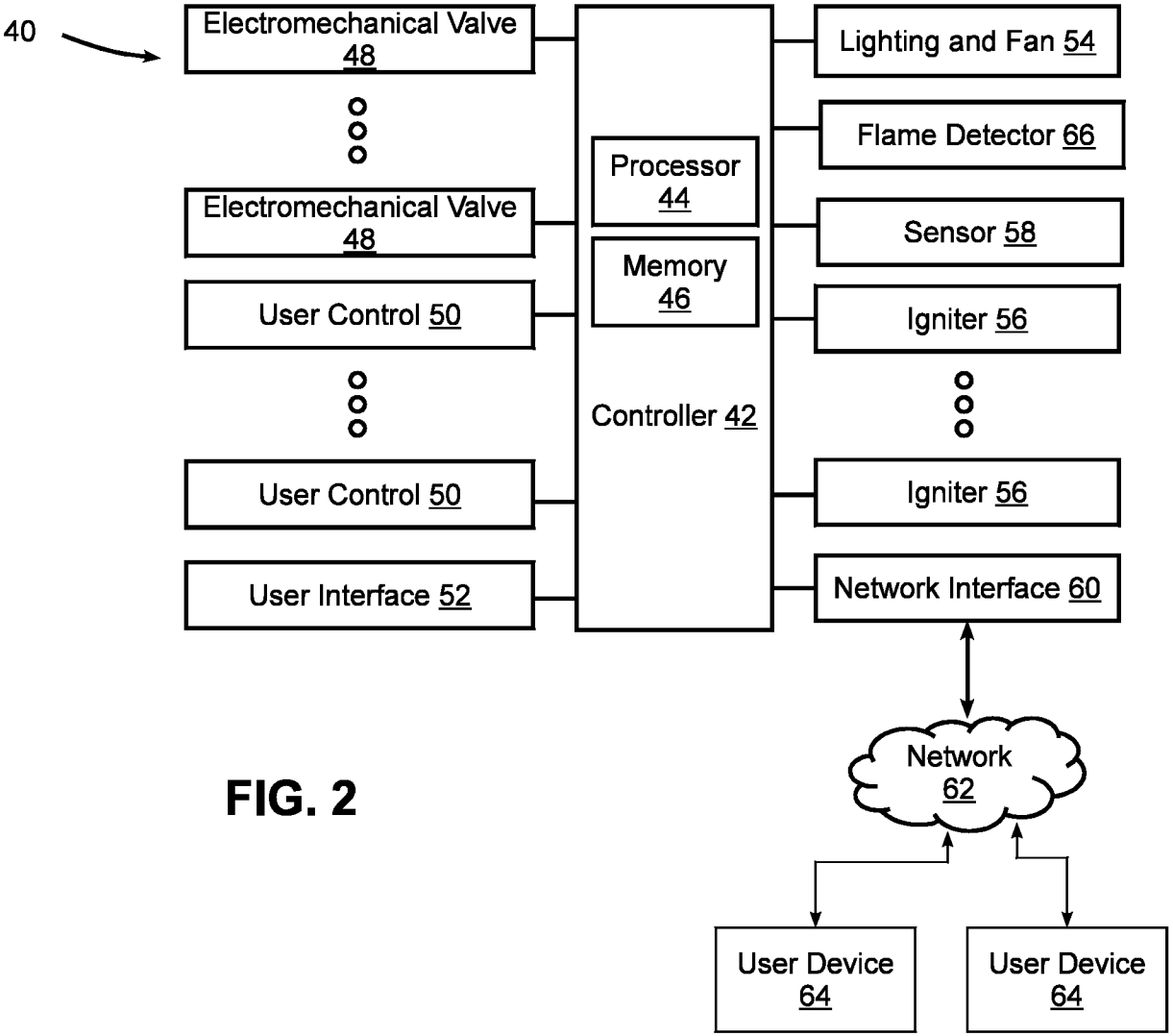
FIG. 2 is a block diagram of an example control system for a digital gas cooking appliance, consistent with some embodiments of the disclosure.

A cooking appliance consistent with the disclosure also generally includes one or more controllers configured to control the cooking elements and otherwise perform cooking operations at the direction of a user. FIG. 2, for example, illustrates an example of a digital gas cooking appliance control system 40 including a controller 42 that receives inputs from a number of components and drives a number of components in response thereto. The digital gas cooking appliance control system 40 may be implemented using practically any type of cooking appliance, e.g., a range, stovetop, single oven, double oven, wall oven, standalone oven, etc. The controller 42 may, for example, include one or more processors 44 and a memory 46 within which may be stored program code for execution by the one or more processors. The memory may be embedded in the controller 42, but may also be considered to include volatile and/or non-volatile memories, cache memories, flash memories, programmable read-only memories, read-only memories, etc., as well as memory storage physically located elsewhere from the controller 42, e.g., in a mass storage device or on a remote computer interfaced with the controller 42.

As shown in FIG. 2, the controller 42 may be interfaced with various components, including a plurality of non-gas cooking elements used for cooking food (e.g. burners, oven heating elements, and the like), a plurality of manually-actuated user controls 50 for receiving user input (e.g., various combinations of switches, knobs, buttons, sliders, touchscreens or touch-sensitive displays, microphones or audio input devices, image capture devices, etc.), and a user interface 52 (including various indicators, graphical displays, textual displays, speakers, touch screens, control selectors, etc.). Further, for any gas cooking elements (not shown in FIG. 2), a plurality of electromechanical valves 48 may be provided to regulate the gas flow rate to such gas cooking elements, and one or more flame detectors 66 may be provided to detect the presence of a flame in the gas cooking elements. The controller 42 may also be interfaced with various additional components suitable for use in a cooking appliance, e.g., one or more lights and/or one or more fans 54 (e.g., an oven light, a cooktop light, a convection fan, cooling fan, etc.), among others. It will be appreciated, for example, that the controller 42 may be interfaced with each electromechanical valve 48 and one or more igniters 56 to ignite gas supplied to the gas cooking elements.

In some embodiments, the controller 42 may also be interfaced with various sensors 58 located to sense environmental conditions inside of and/or external to the digital cooking appliance control system 40, e.g., one or more pressure sensors, temperature sensors, humidity sensors, air quality sensors, smoke sensors, carbon monoxide sensors, odor sensors and/or electronic nose sensors, among others. Such sensors may be internal or external to the digital cooking appliance control system 40, and may be coupled wirelessly to the controller 42 in some embodiments.

In some embodiments, the controller 42 may also be coupled to one or more network interfaces 60, e.g., for interfacing with external devices via wired and/or wireless networks such as Ethernet, Wi-Fi, Bluetooth, NFC, cellular and other suitable networks, collectively represented in FIG. 2 at 62. The network 62 may incorporate in some embodiments a home automation network, and various communication protocols may be supported, including various types of home automation communication protocols. In other embodiments, other wireless protocols, e.g., Wi-Fi or Bluetooth, may be used. In some embodiments, the digital gas cooking appliance control system 40 may be interfaced with one or more user devices 64 over the network 62, e.g., computers, tablets, smart phones, wearable devices, etc., and through which the digital gas cooking appliance control system 40 may be controlled and/or the digital gas cooking appliance control system 40 may provide user feedback.

In some embodiments, the controller 42 may operate under the control of an operating system and may execute or otherwise rely upon various computer software applications, components, programs, objects, modules, data structures, etc. In addition, the controller 42 may also incorporate hardware logic to implement some or all of the functionality disclosed herein. Further, in some embodiments, the sequences of operations performed by the controller 42 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the cooking appliance 10 and the cooking appliance control system 40 illustrated in FIGS. 1 and 2 will be apparent to one of ordinary skill in the art, as will become apparent from the description herein. Therefore, the disclosure is not limited to the specific implementations discussed herein.

The present disclosure is mainly directed to a digital gas cooking appliance that has the ability to self-initiate a calibration process by performing a plurality of ignition sequences at a plurality of respective valve positions of the electromechanical valve to optimize the ignition process of the gas cooking element. During each of the plurality of ignition sequences of such calibration processes, the controller of the digital gas cooking appliance may be configured to set the electromechanical valve to the respective valve position and determine a respective ignition duration between a start of the respective ignition sequence when the igniter is active and the electromechanical valve is open, and detection of the flame of the gas cooking element by the flame detector. Further, in some embodiments, the controller may be configured to determine an optimum valve position of the electromechanical valve for ignition of the gas cooking element through the calibration process to optimize, and specifically, to minimize the ignition duration of the gas cooking element based upon the particular conditions associated with the gas cooking element. In some embodiments, the calibration process may be triggered when the measured ignition duration meets a predetermined ignition duration criterion. In some other embodiments, a diagnostic process may be configured to suggest one or more ignition performance improving actions to a user when the measured ignition duration meets a predetermined ignition duration criterion.

Figure 3:
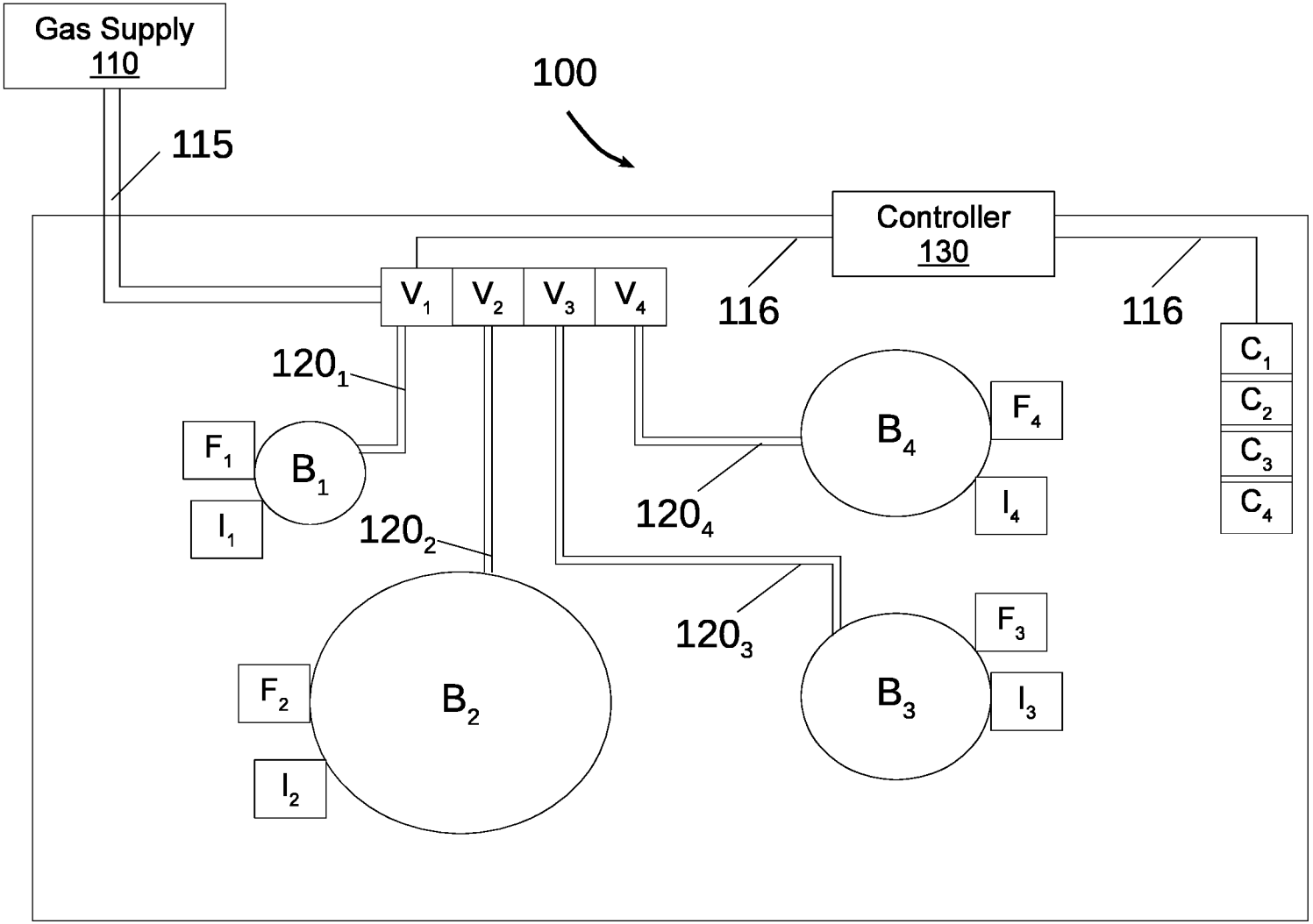
FIG. 3 is a control system for controlling a digital gas cooking appliance, consistent with some embodiments of the disclosure.
Figure 5:
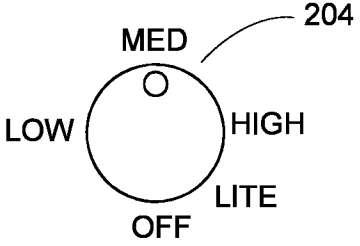
FIG. 5 is an enlarged front view of the rotary burner control knob of FIG. 4, consistent with some embodiments of the disclosure.
Figure 4:
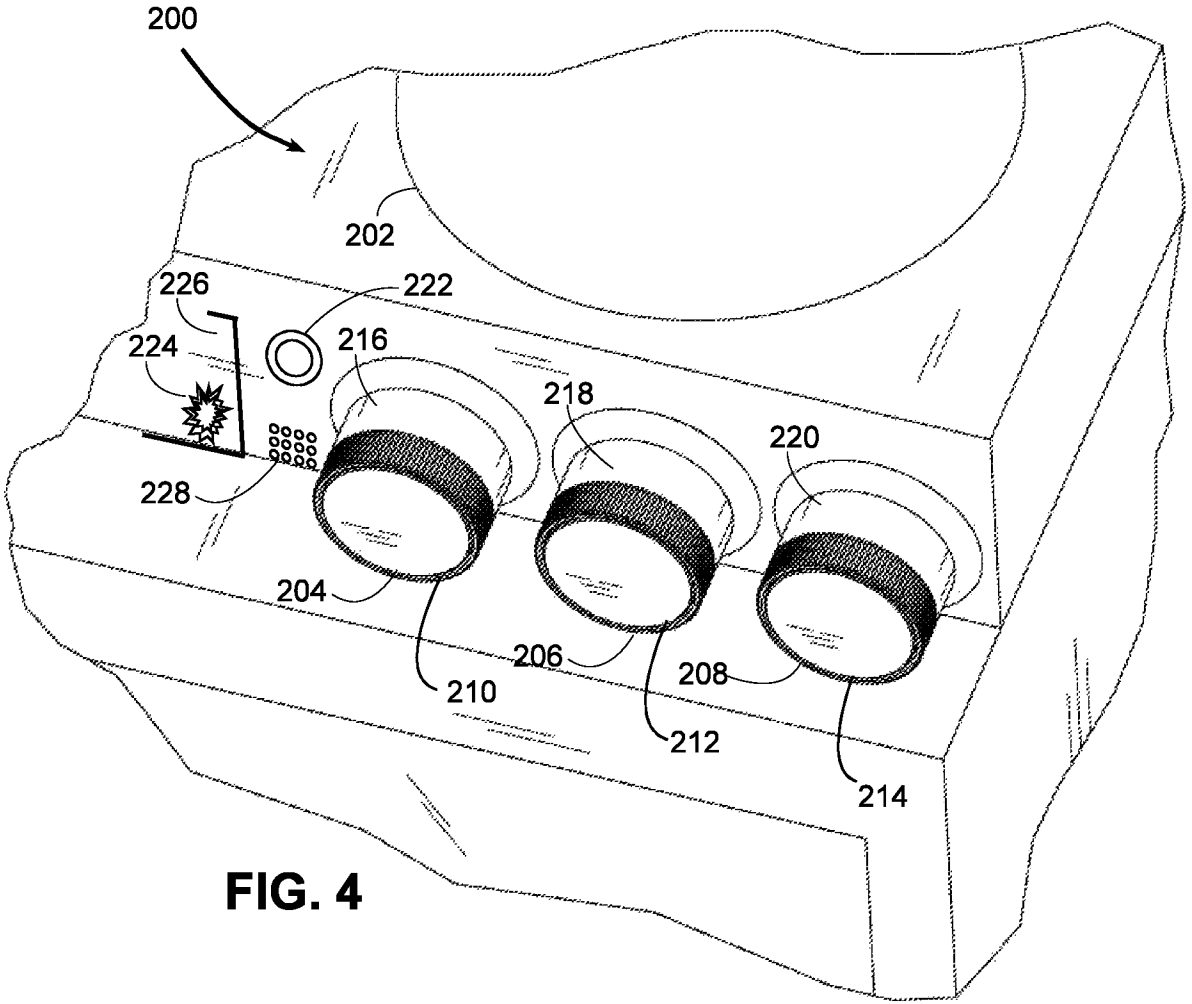
FIG. 4 is a partial perspective view of a digital gas cooking appliance implementing the control system of FIG. 3 with rotary burner control of electromechanical valves, consistent with some embodiments of the disclosure.

Now turning to FIGS. 3-5, various embodiments of digital gas cooking system hardware environment directed to achieve the above objectives are illustrated in greater detail. To better illustrate how the calibration process as described above works, an embodiment of a digital gas cooking system 100 is illustrated in FIG. 3. As shown in FIG. 3, a gas, liquid, or fuel supply functionally represented by block 110 may be fed into one or more gas valves through a main gas piping or tubing line 115, or the like, with one or more gas valves capable of regulating gas flow thereto. As will become more apparent below, the one or more gas valves may be implemented as a plurality of variable electronically-controlled electromechanical gas valves $V_1$, $V_2$, $V_3$, and $V_4$ coupled to a plurality of manually-actuated user controls $C_1$, $C_2$, $C_3$, and $C_4$ through a controller 130 via an electrical connection 116. In some embodiments, each electromechanical valve $V_1$, $V_2$, $V_3$, and $V_4$ may further include a stepper motor, which divides a full rotation of the valve into a number of equal steps, allowing for fine adjustment of the electromechanical valve. In some embodiments, the stepper motor may be a step motor with 400 steps per revolution, but this is not to be understood as limiting, as the number of steps may vary. In some embodiments, such as illustrated, there may be four electromechanical valves $V_1$, $V_2$, $V_3$, and $V_4$; in other embodiments, the number of valves may vary. The number, capacity, and/or the arrangement of the electromechanical valves are not intended to be limiting, as a person of ordinary skill in the art would recognize these may vary based on user desire, costs, design aesthetics, or any number of other considerations. In some embodiments, for example, an additional master valve may be used, while in other embodiments, each cooking element or burner may include multiple valves in series, e.g., a shut-off valve in series with a variable valve.

As illustrated in FIG. 3, the digital gas cooking system 100 may include a plurality of burners $B_1$, $B_2$, $B_3$, and $B_4$, and each of the burners $B_1$, $B_2$, $B_3$, and $B_4$ may be fluidly coupled to the plurality of electromechanical valves $V_1$, $V_2$, $V_3$, and $V_4$ respectively, where the electromechanical valves $V_1$, $V_2$, $V_3$, and $V_4$ are configured to regulate the gas flow rate to each of the burners $B_1$, $B_2$, $B_3$, and $B_4$. In this regard, each burner may be considered to be a gas cooking element, and these terms will be used interchangeably herein. This fluid coupling may be through the use of gas piping or tubing 120$_{1-4}$, or the like, running between each valve $V_1$, $V_2$, $V_3$, and $V_4$ and each burner $B_1$, $B_2$, $B_3$, and $B_4$. The burners $B_1$, $B_2$, $B_3$, and $B_4$ may have different output capacities, as illustrated by their relative sizes. For example, the burner $B_1$ may be a small capacity burner, burners $B_3$ and $B_4$ may be medium capacity burners, and burner $B_2$ may be a large capacity burner. In some embodiments, the cooktop may contain a varying number of burners, for example, some cooktops may only contain one or two burners, while other cooktops may contain six or more burners. In other embodiments, the burners of the cooktop may vary in size or output capacity, for example some cooktops may contain burners of identical capacity, while other cooktops may contain only two different capacity burners. In still other embodiments, the arrangement of the burners may also vary from the illustration of FIG. 3. The number, capacity, and/or the arrangement of the burners are not intended to be limiting, as a person of ordinary skill in the art would recognize these may vary based on user desire, costs, design aesthetics, or any number of other considerations.

The digital gas cooking system 100 may further include a plurality of manually-actuated user controls $C_1$, $C_2$, $C_3$, and $C_4$, each of which may be movable over a range of positions. Such a range of positions may include only a portion of the full range of positions of a control in some embodiments. For example, in some embodiments, the manually-actuated user control may be a rotary control knob as illustrated in FIG. 4. In some embodiments, such a rotary control knob may be capable of a full 360 degrees rotation; in other embodiments, the rotary control knob may only rotate over a portion or subset of the possible positions. In some other embodiments, the manually-actuated user control may be a slider that slides over the range of positions, or various other types of variable controls capable of outputting a variable control signal within a range of values.

The digital gas cooking system 100 may additionally include a controller 130 that is coupled to each of the manually-actuated user controls $C_1$, $C_2$, $C_3$, and $C_4$, and to each of the electromechanical valves $V_1$, $V_2$, $V_3$, and $V_4$. This coupling may be wired through the electrical connection 116, as illustrated in FIG. 3, or may be wireless. The controller 130 may be configured to determine what position each of the manually-actuated user controls $C_1$, $C_2$, $C_3$, and $C_4$ is in, within all possible positions, e.g., using an encoder or another rotational position sensor coupled to each control. For example, the controller 130 may determine that the burner $B_1$ is off, the burner $B_2$ is on and the user control $C_2$ is turned 180 degrees, the burner $B_3$ is off, and the burner $B_4$ is on and the user control $C_4$ is turned 210 degrees. The controller 130 may control each electromechanical valve $V_1$, $V_2$, $V_3$, and $V_4$ based on the determined position of each of the manually-actuated user controls $C_1$, $C_2$, $C_3$, and $C_4$. The controller 130 may control each of the electromechanical valves $V_1$, $V_2$, $V_3$, and $V_4$ so as to provide a controlled relationship between the gas flow from the valves $V_1$, $V_2$, $V_3$, and $V_4$ to the each of the burners $B_1$, $B_2$, $B_3$, and $B_4$ and the position of each the manually-actuated user controls $C_1$, $C_2$, $C_3$, and $C_4$. It will be appreciated that in these embodiments, each valve $V_1$, $V_2$, $V_3$, and $V_4$ is controlled based upon the position of the respective corresponding user control $C_1$, $C_2$, $C_3$, and $C_4$, and as such, each valve may be controlled independently of the state of any other valve in the digital cooking system 100. In other embodiments, however, the state of each of the electromechanical valves $V_1$, $V_2$, $V_3$, and $V_4$ may be used as an input to control the state of another valve, e.g., to effectively adjust the position of the electromechanical valve $V_1$ based upon the state of electromechanical valves $V_2$, $V_3$, and/or $V_4$. Moreover, in some embodiments, only a subset of the burners or cooking elements in a cooking appliance may be controlled in the herein-described manner, with other burners or cooking elements controlled in a different manner.

In some embodiments, and as illustrated in FIGS. 4-5, the digital gas cooking system 100 illustrated in FIG. 3 may be applied on a digital gas cooking appliance controlled by one or more electromechanical valves that are electromechanically coupled to one or more control actuators such as knobs or sliders. FIG. 4, in particular, illustrates a digital gas range 200 including a gas cooking element 202 and a set of gas cooking element controls 204, 206, and 208, e.g., rotary control knobs, each with a control actuator 210, 212, and 214, e.g., a rotary control actuator or knob. In some embodiments, one or more of gas cooking element controls 204, 206, and 208 may be used to control an oven, rather than a cooktop. For example, the gas cooking element controls 204 and 206 may be used to control the gas cooking element 202 that may be a cooktop burner, while the gas cooking element control 208 may also be used to control a gas oven burner.

During use, in order to generate alerts or indications to a user (e.g., to signal an alert to a user of a need to perform a calibration or diagnostic operation), the gas range 200 may include various types of electrical indicator devices, e.g., an illuminated light or LED-backlit ring 216, 218, and 220 on each burner control 204, 206, and 208, a separate, dedicated visual indicator such as an LED 222 on the control panel, an illuminated icon 124 and/or text displayed on a user interface 226, or a speaker 228 for use in generating audible indications. An indication could also be generated proximate the burner itself, e.g., using a light source positioned close to the burner. An indication, in this regard, may be considered to include any type of visual and/or audible presentation to a user that may be recognized as an alert by a user, and in some instances, an indication may be generated on a device that is remote from a cooking appliance, e.g., on an interconnected smart home device, mobile device, etc. It will also be appreciated that the various indications 216, 218, 220, 222, 224, and 228 illustrated in FIG. 4 are merely shown on a single device for illustrative purposes, and that a cooking appliance consistent with the invention may utilize as few as one such indicating device, indicator, illumination source, speaker, etc. in some embodiments.

As shown in FIG. 5, an ignition process of the gas cooking element 202 may be performed in some embodiments by rotating the rotary burner control 204 counter-clockwise from "OFF" position to an "LITE" range (i.e., a sparking range between "OFF" and "HIGH") to activate an igniter to create sparks to ignite the gas flow. It will be appreciated that the illustration in FIG. 5 is not limited, and the burner control 204 for digital gas systems may be rotated in either direction (i.e., clockwise for ignition), and in some instances, a user may not be required to rotate the burner control to a specific "LITE" position, but rather may initiate an ignition merely by rotation of the burner control in a particular direction. In other instances, an ignition operation may be initiated used a separate "IGNITE" or "LITE" button that could be associated with a particular burner control (e.g., a physical button or a touch sensor associated with the control) or alternatively could be a master button used by multiple gas cooking elements. As mentioned previously, for digital gas systems, one or more igniters may be controlled by controller 130 for ignition of gas cooking elements of the digital gas cooking system. In such embodiments, for example as shown in FIGS. 3-5, when a user tries to ignite the gas cooking element 202, e.g., one of the burners $B_1$, $B_2$, $B_3$, and $B_4$, the controller 130 may be configured to initiate the corresponding igniter, e.g., one of the igniters $I_1$, $I_2$, $I_3$, and $I_4$, to create a spark while the corresponding electromechanical valve $V_1$, $V_2$, $V_3$, and $V_4$ is set to a predetermined ignition valve position to ignite the gas supply 110 supplied to the gas cooking element 202. If the ignition process is successful, the user may continue rotating the control knob 204 to a position within a range of positions corresponding to a gas valve position for a desired gas flow rate and corresponding output level of the gas cooking element 202.

However, if the predetermined valve position of the electromechanical valve for ignition provides too much or too small gas flow to the gas cooking element 202, a risk exists that the ignition duration may be too long or the ignition may even fail. To avoid this issue, it is therefore generally desirable to configure and set predetermined valve position setting of the electromechanical valve to one that is capable of having the ignition duration in an acceptable range. However, as the ignition duration and the corresponding predetermined gas valve position supplying the optimum amount of gas required for an acceptable ignition process for a particular gas cooking element may be influenced by various factors, including, for example, the pressure of the gas supply, the size and/or type of the gas cooking element, the operating states of other gas cooking elements, and the type of gas (e.g., propane or natural gas), the predetermined valve position setting of the electromechanical valve for ignition may not provide the appropriate amount of gas flow for an acceptable ignition process under certain situations (e.g., a change of the gas type supplied). In order to ensure that the valve setting is capable of addressing all of these different factors, a self-initiated auto-calibrating process may be desired.

To achieve the calibration process, it is desired to be able to measure an ignition duration of the burners $B_1$, $B_2$, $B_3$, and $B_4$ under different conditions, e.g., different valve positions, by the digital gas system. For example, the ignition duration may be defined in some embodiments from when an ignition sequence has started until a flame is sensed by a flame detector. The start of an ignition sequence for a gas cooking element may generally be considered in some embodiments to be the time at which both the associated ignitor is active (e.g., for a spark ignitor, when the spark ignitor is generating sparks) and the associated electromechanical valve is open and supplying gas to the gas cooking element (as it will be appreciated that in different embodiments, these two operations could occur simultaneously, or one of these two operations could be initiated prior to the other operation). To realize the ignition duration measurement used in the calibration process, the digital gas cooking system 100 may include one or more flame detectors $F_1$, $F_2$, $F_3$, and $F_4$ to detect a flame state in the one or more of the burners $B_1$, $B_2$, $B_3$, and $B_4$, as additional inputs for controlling the electromechanical valves $V_1$, $V_2$, $V_3$, and $V_4$. Each flame detector $F_1$, $F_2$, $F_3$, and $F_4$ may be a sensor coupled to the controller 130 to detect the presence of heat and/or a flame for gas cooking elements as additional input for controlling the digital gas cooking system 100. It will be appreciated that each flame detector may be any other suitable type of sensor capable of determining whether the burner is currently on. In some embodiments, the flame detector may include an infrared camera, infrared thermometer, thermal imaging camera, ultraviolet flame detector, flame ionization spectrometer, pyrometer, thermocouple, flame sense rod, or vision system. It will be appreciated that various technologies may be used for monitoring the flame, and the number and the location of the flame detectors $F_1$, $F_2$, $F_3$, and $F_4$ are not limited. In some embodiments, such as illustrated in FIG. 3, the number of the flame detectors $F_1$, $F_2$, $F_3$, and $F_4$ may correspond to the number of burners $B_1$, $B_2$, $B_3$, and $B_4$; however, in other embodiments, the number of the flame detectors $F_1$, $F_2$, $F_3$, and $F_4$ may vary. For example, there may be only one flame detector for detecting the presence of a flame for all the burners $B_1$, $B_2$, $B_3$, and $B_4$ simultaneously. Furthermore, although illustrated as positioned adjacent the burners $B_1$, $B_2$, $B_3$, and $B_4$ in FIG. 3, this is not intended to be limiting, as the one or more flame detectors $F_1$, $F_2$, $F_3$, and $F_4$ may be positioned anywhere feasible for flame detection in the cooking appliance 10. The controller 130 may then be configured to measure and determine the ignition duration of each burner $B_1$, $B_2$, $B_3$, and $B_4$.

In some embodiments, the calibration process may include a plurality of ignition sequences for each the gas burner $B_1$, $B_2$, $B_3$, and $B_4$ at a plurality of respective valve positions for the corresponding electromechanical valves $V_1$, $V_2$, $V_3$, and $V_4$. During each of the plurality of ignition sequences, the controller 130 may be configured to set the selected electromechanical valves $V_1$, $V_2$, $V_3$, and $V_4$ to the respective valve position, and determine a respective ignition duration as described previously. In such embodiments, the controller 130 may be further configured to determine an optimum valve position of each the electromechanical valves $V_1$, $V_2$, $V_3$, and $V_4$ for ignition of the gas burners $B_1$, $B_2$, $B_3$, and $B_4$ from the determined respective ignition durations to minimize ignition duration to determine a minimum ignition duration $T_m$. In such embodiments, the controller 130 may be further configured to use the determined optimum valve position to set the electromechanical valves $V_1$, $V_2$, $V_3$, and $V_4$ during ignition in response to user input to ignite the gas burners $B_1$, $B_2$, $B_3$, and $B_4$. Effectively, the controller in some embodiments may empirically determine an optimum valve position by attempting to ignite a gas cooking element using different valve positions, measuring the ignition duration for each valve position, and then determining an optimum valve position that minimizes the ignition duration from the measured durations. Further, a controller may determine optimum valve positions for a gas cooking element under different conditions, e.g., so that different valve positions will be used to ignite a gas cooking element based upon the conditions under which the gas cooking element is being ignited—such as the states of other gas cooking elements when a particular gas cooking element is being ignited.

Figure 6:
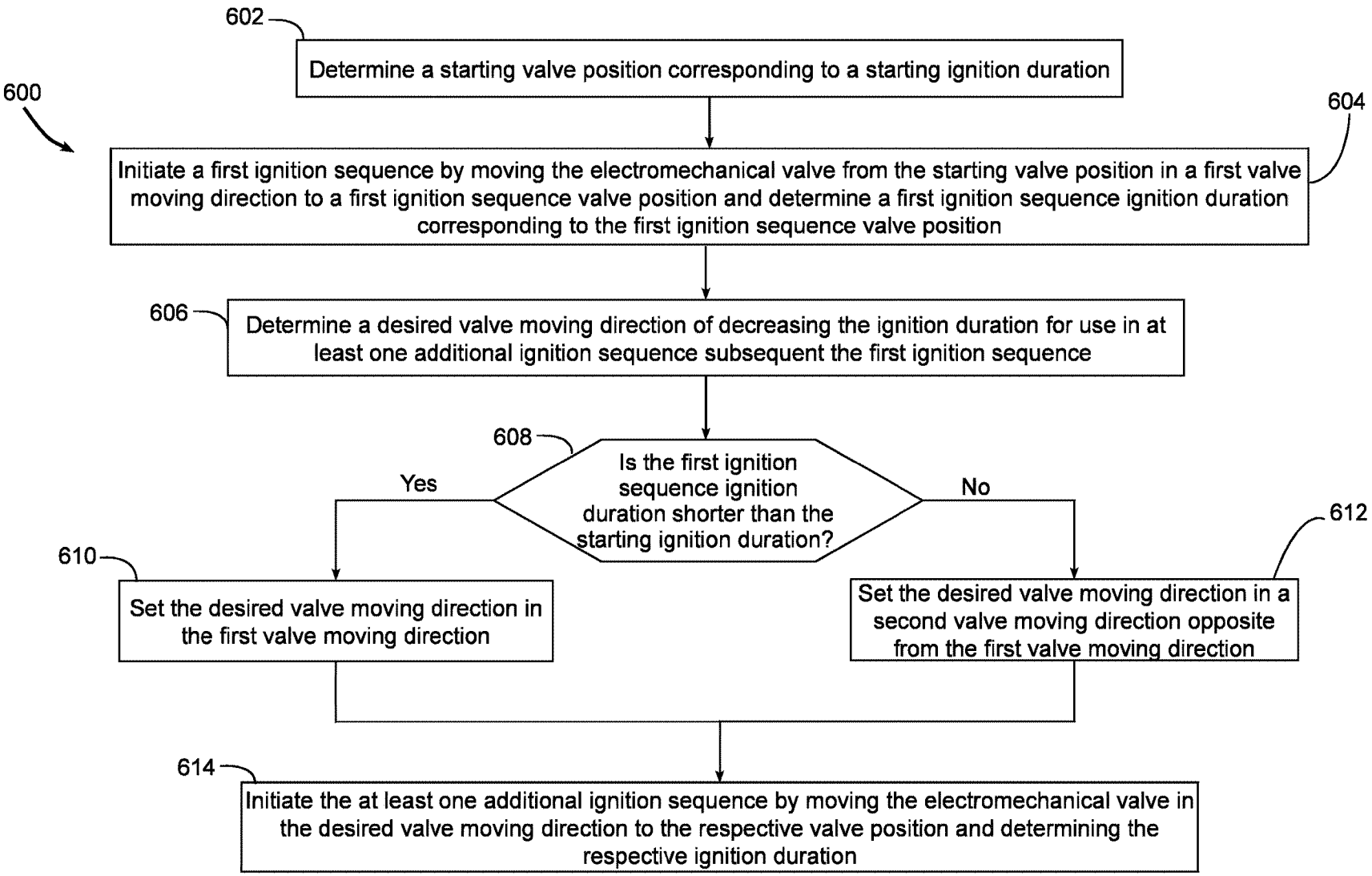
FIGS. 6-8 are flowcharts illustrating example sequences of operations for a digital gas cooking appliance, consistent with some embodiments of the disclosure.

The plurality of ignition sequences may be performed in various ways. Referring to FIG. 6, an embodiment of a sequence 600 for conducting a calibration process including a plurality of ignition processes described herein is illustrated. As shown in FIG. 6, in some embodiments, the controller 130 may be configured to start the plurality of ignition sequences involved in the calibration process by determining a starting valve position corresponding to a starting ignition duration at block 602. In some embodiments, the starting valve position may be predetermined by factory programming so that when a user tries to ignite the gas cooking element, its corresponding electromechanical gas valve is set at a predetermined valve position to provide a prescribed gas flow rate for ignition (e.g., 60% to 80% of the maximum gas flow rate of the gas cooking element). In such embodiments, the prescribed flow rate and corresponding predetermined starting valve position may be determined through lab testing in the design phase of each individual gas cooking element. For example, the controller 130 may be configured to control the electromechanical valve $V_1$ to an empirically predetermined starting ignition valve position $P_s$ to supply a certain amount of gas flow to the burner $B_1$ for ignition and determine the corresponding starting ignition duration $T_s$ to start the calibration process. In some other embodiments, the starting valve position may be a valve position stored in the memory of the controller 130 determined through one or more previous calibration processes. Then at block 604, the controller 130 may be configured to initiate a first ignition sequence by moving the electromechanical valve from the starting valve position in a first valve moving direction (i.e., reduce or increase a gas flow rate for ignition) to a first ignition sequence valve position and determine a first ignition sequence ignition duration corresponding to the first ignition sequence valve position $P_f$. For example, the controller 130 may be configured to control the electromechanical valve $V_1$ to a new valve position (i.e., the first ignition sequence valve position) $P_f$ from the starting valve position $P_s$ in a direction of increasing the gas flow rate supplied to the burner $B_1$, and initiate the igniter $I_1$ to ignite the burner $B_1$ and determine a first ignition sequence ignition duration $T_f$ corresponding to the first ignition sequence valve position $P_f$.

Next, at block 606, a desired valve moving direction of decreasing the ignition duration for use in at least one additional ignition sequence subsequent the first ignition sequence may be determined by the controller 130 through the comparison between the first ignition sequence ignition duration and the starting ignition duration, e.g., between $T_s$ and $T_f$, as shown at block 608. If the first ignition sequence ignition duration $T_f$ is shorter the starting ignition duration $T_s$, the controller 130 may be configured to determine the desired valve moving direction is the first valve moving direction at block 610. If the first ignition sequence ignition duration $T_f$ is longer than or equal to the starting ignition duration $T_s$, the controller 130 may be configured to determine the desired valve moving direction is a second valve moving direction opposite from the first valve moving direction at block 612. With the desired valve moving direction being determined, the controller 130 may then be configured to initiate the at least one additional ignition sequence by moving the electromechanical valve in the desired valve moving direction to the respective valve position and determining the respective ignition duration at block 614. Block 614 may be performed multiple times in some embodiments, e.g., until the ignition duration stops decreasing or starts increasing. In summary, the calibration process may include a plurality of trials of ignition processes by starting from a known ignition valve position of the electromechanical valve with a known ignition duration (determined either through prior testing or through a new test), adjusting the electromechanical valve to a new valve position, determining a new ignition duration, determining a valve moving direction of decreasing the ignition duration by comparing the new ignition duration with the known ignition duration, continuing adjusting the electromechanical valve in the direction of decreasing the ignition duration, and determining a new ignition time again.

In some embodiments, the calibration process may continue in the direction of decreasing the ignition duration until the ignition duration reaches a minimum value $T_m$. For example, the desired valve moving direction is determined to be the valve moving direction of decreasing the gas flow rate through the ignition trials as described above. With the electromechanical valve $V_1$ gradually closing, the ignition duration may finally reach a point at which the ignition duration for the burner $B_1$ does not change any more, e.g., a minimum value $T_m$, and the corresponding valve position may be determined as an optimum valve position $P_o$. In some instances, a minimum may be reached and the duration may start to increase, whereby a prior valve position corresponding to the minimum duration may be determined to be optimum. Further, in some instances, interpolation or curve fitting may be used to select an optimum valve position that is intermediate one or more tested valve positions. In some embodiments, the determined optimum position $P_o$ of the electromechanical valve $V_1$ corresponding to the minimum ignition duration $T_m$ may be memorized in the memory of the controller 130 as indicated in FIG. 2, and the controller 130 may be further configured to use the determined optimum valve position $P_o$ to set the electromechanical valve $V_1$ during ignition in response to user input to ignite the burner $B_1$. It will be appreciated that all the valve positions and corresponding ignition durations determined through each of the plurality of ignition sequences during the calibration process may be memorized and configured by the controller 130 in a similar manner. It will also be appreciated that an optimum valve position setting of the electromechanical valves $V_2$, $V_3$, and $V_4$ corresponding to a minimum ignition duration for the burner $B_2$, $B_3$, and $B_4$ may be calibrated and determined in a similar manner with the calibration process such that control over the associated valve during ignition is restricted to the positions within the optimum valve position range.

In some embodiments, the calibration process including the plurality of ignition sequences as described above may be performed during normal use of a digital gas cooking appliance. In such embodiments, at least some of the plurality of ignition sequences may be performed when a user ignites the gas cooking element. For example, each time a user ignites the burner $B_1$, the controller 130 may be configured to select a new valve position of the electromechanical valve $V_1$ for ignition, which is different from the current valve setting for ignition, and compare the new ignition duration corresponding to the new valve position with the current ignition duration value. If the new ignition duration is shorter, the controller 130 may be configured to replace the current valve setting with the new valve position of the electromechanical valve $V_1$. In such a manner, an optimum valve position for ignition may be determined after a period of time of normal use of the digital gas cooking appliance 100. In some embodiments, the period of time of normal use of the digital gas cooking appliance may be predetermined and adjusted according to user preferences (e.g., 5 days, 2 weeks, etc.). Further, where a gas cooking element may be operable in a variety of conditions, calibration may determine optimum valve positions corresponding to different conditions. In one example embodiment, each gas cooking element may be tested with one or more other gas cooking elements active to determine optimum valve positions for each gas cooking element based upon the on/off status of each other gas cooking element when ignition of a particular gas cooking element is requested. Thus, for example, if a user requests ignition of one gas cooking element while two other gas cooking elements are already on, a valve position that has been determined to be optimum for that particular combination of active gas cooking elements may be used to ignite the gas cooking element.

In some embodiments, the controller 130 may be configured to move the electromechanical valve $V_1$ in the desired valve moving direction with a fixed change amount of the gas flow rate to the respective valve position and determine the respective ignition duration. In some embodiments, the starting valve position is generally limited by the maximum flow rate supported by the cooking appliance due to the machining of the cooking appliance components (e.g., the type and/or the size of valves, cooking elements, piping lines, etc.). Accordingly, for example, the controller 130 may be further configured to determine the starting valve position corresponding to the starting ignition duration based on the size of the burner $B_1$, the type of the burner $B_1$, the size of the electromechanical valve $V_1$, the type of electromechanical valve $V_1$, and/or the type of gas being supplied to the burner $B_1$ (e.g. natural gas, propane, or the like). The starting valve position of the electromechanical valves $V_2$, $V_3$, and $V_4$ for the burners $B_2$, $B_3$, and $B_4$ may be determined in a similar manner. In other embodiments, the starting valve position for the ignition duration may simply be set as the maximum position for the valve (e.g., a 100% valve open position). In some embodiments, the starting setting may be a starting value of a flow rate, control knob rotation, or the like. In some other embodiments, the starting setting may be determined empirically, e.g., by monitoring the ignition duration while gradually increasing/decreasing the gas flow rate to the gas cooking element. In some embodiments, the controller 130 may be further configured to delay between each of the plurality of ignition sequences to allow for cooling down of the gas burner $B_1$, $B_2$, $B_3$, and $B_4$. The delay may ensure that the burner be cooled down adequately between calibration trials to prevent the high temperature of the gas cooking element from affecting the calibration results, because a warm/hot gas cooking element may be ignited faster than a cold gas cooking element. In some embodiments, the controller 130 may also be configured to override the determined optimum valve position and/or the corresponding minimum ignition duration to a value different from the determination produced by the calibration process in response to user input, if desired.

In some embodiments, the controller 130 may be configured to initiate the calibration process and/or repeat the calibration process in various conditions related to an installation, conversion, or other variation situations, which may otherwise affect the minimum setting of the ignition duration. In some embodiments, the automatic calibration process may be executed upon initial setup of the digital gas cooking appliance, after conversion of the digital gas cooking appliance to use a different type of gas, or on demand by a user or service technician. In some embodiments, the system may initiate the automatic self-calibrate process as describe herein regarding the ignition process when there is a gas change. For example, when the unit is converted from natural gas to liquefied petroleum gas, the calibration process may be initially automatically. In some embodiments, such auto-calibrating of the ignition process may even enable the cooking appliance 10 to omit additional hardware (e.g., an adjustable orifice or a replaceable orifice, etc.) to support different gas types (e.g., natural gas or propane). In some embodiments, the controller 130 may be further configured to initiate the calibration process at an initial setup of the digital gas cooking appliance. In some other embodiments, the controller 130 may be further configured to initiate the calibration process on demand in response to user input.

In some embodiments, the controller 130 may perform the calibration process in real-time by comparing the detected ignition duration with a predetermined criterion. For example, as an ignition duration being larger than a predetermined ignition duration criterion $T_c$ (e.g., 10 seconds, 15 second, etc.) for the burner $B_1$ may be determined by the controller 130 as unsatisfying, and the controller 130 may continuously verify that detected present ignition duration $T_p$ is equal to or smaller than $T_c$ or not to detect unsatisfying ignitions. Accordingly, an alert may be generated when the present ignition duration $T_p$ meets (e.g., has a value that is larger than) the predetermined ignition duration criterion $T_c$ to alert the user or other people in the surrounding area of the fact that the ignition duration for the burner $B_1$ may be too long. In some other examples, for example, if a measurement and/or detection of the calibrated ignition duration determined after the calibration process $T_a$ of the burner $B_1$ is still detected to meet the predetermined ignition duration criterion $T_c$, or any other information that may be available to the controller 130 based on signals from the digital gas cooking system 100, the controller 130 may be further configured to activate a corrective action. In some embodiments, this corrective action may be in the form of some types of an alarm to alert the conditions to the user through a visual, audio, message, or any other type of suitable alarm.

The predetermined ignition duration criterion may be a variety of amounts and/or be defined by the user in various embodiments. In some embodiments, the predetermined ignition duration criterion may be an optimum ignition duration based on empirical testing and set during manufacture. For example, the predetermined ignition duration criterion may be measured in the lab for various types of gases (e.g., natural gas, propane, etc.), and the predetermined ignition duration criterion may be taken as the target or reference time stored in the memory of the controller 130 as indicated in FIG. 2. In some other embodiments, the predetermined ignition duration criterion may be programmed and adjusted by the user according to their preference.

Besides a traditional audible sound alert, in some embodiments, the alert may be a haptic alert (e.g., a vibration on the user control). In some embodiments, the alert may be a visual alert (e.g., flashing lights through indicators on the user control). When the alert has been triggered as noted above, the user may deactivate the alert in different manners. For example, in some embodiments, activating a button, switch, or a sensor may deactivate the alert. Alternatively or in addition to the herein described actions, a variety of other user actions or appliance conditions may deactivate the alert.

In some embodiments, the corrective action may be a diagnostic process, and the controller 130 may be configured to initiate the diagnostic process by suggesting an ignition performance improving action to the user. In such embodiments, the ignition performance improving action may include an adjustment/cleaning of the gas cooking element and/or the igniter, or an inspection of the type/pressure of the gas supplied. For example, if the measurement and/or detection of the calibrated ignition duration determined after the calibration process $T_a$ of the burner $B_1$ still fails to meet the predetermined ignition duration criterion $T_c$, it may indicate a dirty burner and/or an associated igniter. Then, the controller 130 may be configured to suggest the user to clean the burner $B_1$ and the associated igniters $I_1$ to bring the ignition duration back to an acceptable range. In other words, the detected ignition duration measurements may be used as a variable in measuring the status of the digital cooking appliance, such as the gas cooking element "cleanliness" as a longer ignition duration may be caused by filthy burners or igniters.

As the reason for a slow ignition may vary (e.g., a lower gas supply pressure than normal, a different gas type supplied, a poor condition of the gas cooking element, etc.), and the slow ignition may happen anytime during the cooking operation, in some embodiments, the ignition duration may be checked over time, and if it is found that at some point the ignition duration falls outside of a prescribed tolerance, the calibration process, the diagnostic process, and/or the alert as described herein may be initiated or suggested to the user by the controller 130. For example, in some embodiments, the controller 130 may be configured to initiate the diagnostic process by suggesting a user to check on the status of the burner $B_1$ in response to determining that the present ignition duration $T_p$ for the gas burner $B_1$ meets the predetermined ignition duration criterion $T_c$. In some embodiments, the digital gas cooking system 100 may further include a user interface or a user interface display coupled to the controller 130 as discussed previously, and the controller 130 may be configured to suggest performance of the ignition process to the user via the user interface or the user interface display 30 and 32 as shown in FIG. 1. In some embodiments, the controller 130 may also be configured to suggest performance of the ignition process to the user via a remote user interface (e.g., an external device such as a smart phone) in response to the ignition duration meets a predetermined ignition duration criterion.

Figure 8:
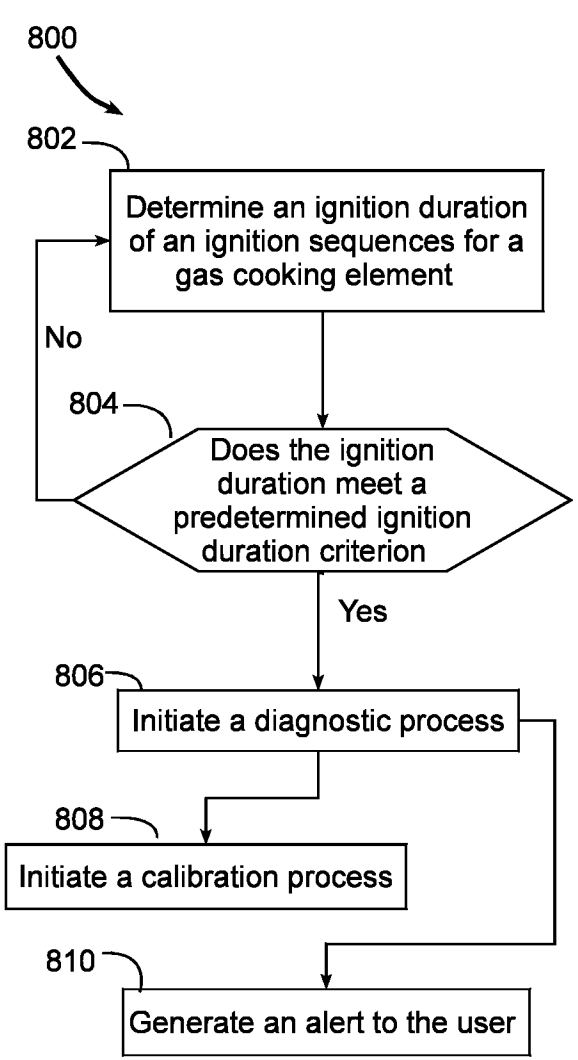
Figure 7:
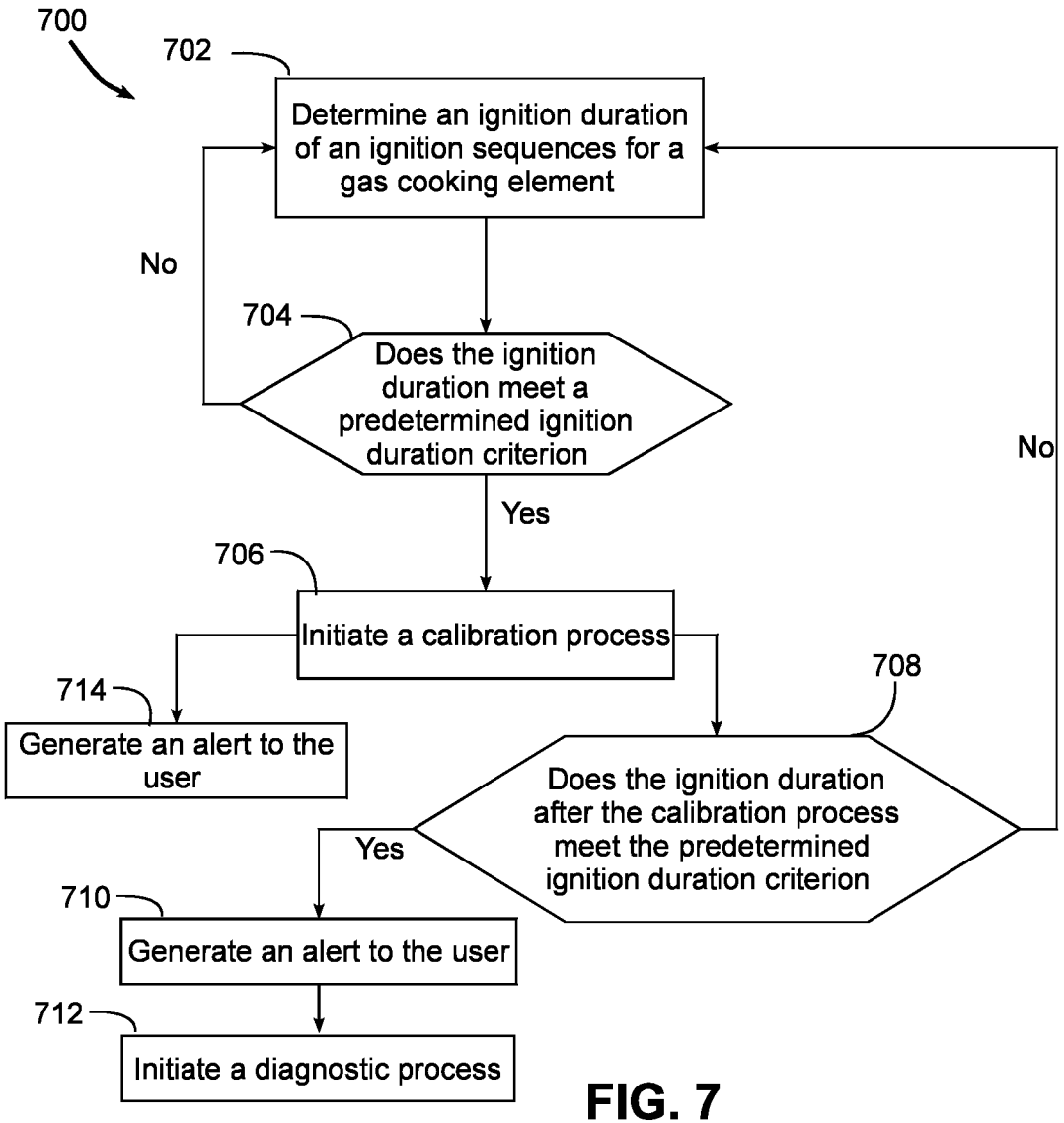

Now turning to FIGS. 7-8, these figures illustrate various sequences of operations for performing calibration operations in digital gas cooking appliances consistent with some embodiments of the disclosure as described above. Referring now to FIG. 7, an embodiment of a sequence 700 for operating a digital gas system incorporating above control strategies is illustrated. The sequence 700 may be implemented, for example, by the controller 130 of the digital gas cooking system 100 as discussed above. At block 702, the controller 130 may be configured to determine an ignition duration of an ignition sequences for a gas cooking element, e.g., detecting the ignition duration for one of the burners $B_1$, $B_2$, $B_3$, and $B_4$. The controller 130 may then compare the detected ignition duration with a predetermined ignition duration criterion at block 704. This determination may be accomplished through the input signals from the electromechanical valves $V_1$, $V_2$, $V_3$, and $V_4$, the igniters $I_1$, $I_2$, $I_3$, and $I_4$, and the flame detector $F_1$, $F_2$, $F_3$, and $F_4$, etc. Next, based on these input signals, if the detected ignition duration meets the predetermined ignition duration criterion, a calibration process may be initiated by the controller 130 at block 706. In some embodiments, an alert to a user may be optionally generated at block 714 following the initiation of the calibration process at block 706. If the detected ignition duration does not meet the predetermined ignition duration criterion, block 704 passes control back to block 702 to restart the sequence 700. Then, if the determination at block 708 determines that the ignition duration after the calibration process still meets the predetermined ignition duration criterion, an alert may be generated to remind the user at block 710. If the above determination at block 708 is unsatisfied (i.e., the ignition duration after the calibration process has been improved and does not meet the predetermined ignition duration criterion any more), block 708 passes control back to block 702 to restart the sequence 700. In some embodiments, a diagnostic process may be optionally initiated at block 712 following the alert at block 710.

Similar to the sequence 700, a sequence 800 for initiating a diagnostic process may start as illustrated in FIG. 8 by determining an ignition duration of an ignition sequences for a gas cooking element at block 802. Next, by comparison between the detected present ignition duration and the predetermined ignition duration criterion at block 804, the controller 130 may initiate a diagnostic process if the detected present ignition duration meets the predetermined ignition duration criterion. In some embodiments, a calibration process may be optionally initiated at block 808 following the diagnostic process at block 806. In some other embodiments, an alert to a user may be optionally generated at block 810 following the diagnostic process at block 806. If the detected ignition duration does not meet the predetermined ignition duration criterion, block 804 passes control back to block 802 to restart the sequence 800.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein, unless characterized otherwise, are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

The foregoing description of methods and embodiments has been presented for purposes of illustration. It is not intended to be exhaustive or to limit the disclosure to the precise steps and/or forms disclosed, and obviously many modifications and variations are possible in light of the above teaching. It is intended that the scope of the disclosure and all equivalents be defined by the claims appended hereto.

What is claimed is:

1. A digital gas cooking appliance, comprising:

a gas cooking element including an igniter;

an electromechanical valve coupled with the gas cooking element to regulate a gas flow rate thereto;

a flame detector configured to detect a flame of the gas cooking element;

a user control configured to control an output level of the gas cooking element through movement of the user control within a range of positions; and a controller coupled to the igniter, the electromechanical valve, the flame detector, and the user control to control the electromechanical valve to regulate the output level of the gas cooking element in response to user input received through the user control, wherein the controller is configured to initiate a calibration process by performing a plurality of ignition sequences for the gas cooking element at a plurality of respective valve positions for the electromechanical valve, including, during each of the plurality of ignition sequences:

setting the electromechanical valve to the respective valve position; and determining a respective ignition duration between a start of the respective ignition sequence when the igniter is active and the electromechanical valve is open, and detection of the flame of the gas cooking element by the flame detector.

2. The digital gas cooking appliance of claim 1, wherein the controller is further configured to determine an optimum valve position of the electromechanical valve for ignition of the gas cooking element from the determined respective ignition durations to minimize ignition duration.

3. The digital gas cooking appliance of claim 2, wherein the controller is further configured to use the determined optimum valve position to set the electromechanical valve during ignition in response to user input to ignite the gas cooking element.

4. The digital gas cooking appliance of claim 2, wherein the controller is configured to perform the plurality of ignition sequences by:

determining a starting valve position corresponding to a starting ignition duration;

initiating a first ignition sequence of the plurality of ignition sequences by moving the electromechanical valve from the starting valve position in a first valve moving direction to a first ignition sequence valve position and determining a first ignition sequence ignition duration corresponding to the first ignition sequence valve position;

determining a desired valve moving direction of decreasing the ignition duration for use in at least one additional ignition sequence of the plurality of ignition sequences subsequent the first ignition sequence by comparing the first ignition sequence ignition duration with the starting ignition duration, wherein the desired valve moving direction is:

the first valve moving direction if the first ignition sequence ignition duration is shorter than the starting ignition duration; or a second valve moving direction opposite from the first valve moving direction if the first ignition sequence ignition duration is longer than the starting ignition duration; and initiating the at least one additional ignition sequence of the plurality of ignition sequences, including, during each of the at least one additional ignition sequence of the plurality of ignition sequences, moving the electromechanical valve in the desired valve moving direction to the respective valve position and determining the respective ignition duration.

5. The digital gas cooking appliance of claim 4, wherein the controller is configured to move the electromechanical valve in the desired valve moving direction with a fixed change amount of the gas flow rate to the respective valve position and determine the respective ignition duration.

6. The digital gas cooking appliance of claim 4, wherein the controller is configured to determine the starting valve position corresponding to the starting ignition duration based on a size of the gas cooking element, a type of the gas cooking element, a size of the electromechanical valve, a type of the electromechanical valve, and/or a type of gas being supplied to the gas cooking element.

7. The digital gas cooking appliance of claim 2, wherein the controller is further configured to delay between each of the plurality of ignition sequences to allow for cooling down of the gas cooking element.

8. The digital gas cooking appliance of claim 2, wherein the controller is further configured to override the determined optimum valve position of the electromechanical valve for ignition of the gas cooking element in response to user input.

9. The digital gas cooking appliance of claim 1, wherein the controller is further configured to initiate the calibration process after conversion of the digital gas cooking appliance to use a different type of gas.

10. The digital gas cooking appliance of claim 1, wherein the controller is further configured to initiate the calibration process at an initial setup of the digital gas cooking appliance.

11. The digital gas cooking appliance of claim 1, wherein the controller is further configured to initiate the calibration process on demand in response to user input.

12. The digital gas cooking appliance of claim 2, wherein the controller is further configured to generate an alert for a user in response to determining a calibrated ignition duration determined after the calibration process meets a predetermined ignition duration criterion.

13. The digital gas cooking appliance of claim 12, wherein the predetermined ignition duration criterion includes an optimum ignition duration based on empirical testing and set during manufacture.

14. The digital gas cooking appliance of claim 12, wherein the controller is further configured to initiate a diagnostic process by suggesting an ignition performance improving action to a user.

15. The digital gas cooking appliance of claim 14, wherein the ignition performance improving action includes an adjustment/cleaning of the gas cooking element and/or the igniter, or an inspection of the type/pressure of the gas supplied.

16. The digital gas cooking appliance of claim 12, wherein the alert for the user includes an audible alert, a visual alert, or a haptic alert.

17. The digital gas cooking appliance of claim 1, wherein the flame detector includes a thermocouple, a flame sense rod, or a vision system.

18. The digital gas cooking appliance of claim 1, wherein the controller is configured to initiate the calibration process in response to determining a present ignition duration for the gas cooking element between a start of a present ignition sequence when the igniter is active and the electromechanical valve is open, and detection of the flame of the gas cooking element by the flame detector, meets a predetermined ignition duration criterion.

* * * * *